United States Patent [19]

Küssel

[11] 4,130,773

[45] Dec. 19, 1978

[54] X-RAY TUBE WITH LIQUID-COOLED ROTARY ANODE

[75] Inventor: Eckhard Küssel, Düren, Germany

[73] Assignee: Kernforschungsanlage Jülich Gesellschaft mit beschränkter Haftung, Jülich, Germany

[21] Appl. No.: 886,416

[22] Filed: Mar. 14, 1978

[30] Foreign Application Priority Data

Mar. 18, 1977 [DE] Fed. Rep. of Germany ..... 2711847

[51] Int. Cl.[2] ..... H01J 35/10

[52] U.S. Cl. ..... 313/32; 313/60

[58] Field of Search ..... 313/60, 12, 32, 30

[56] References Cited

U.S. PATENT DOCUMENTS 3,870,916 3/1975 Kussel et al. ..... 313/60 X

*Primary Examiner*—Rudolph V. Rolinec
*Assistant Examiner*—Darwin R. Hostetter
*Attorney, Agent, or Firm*—Flynn & Frishauf

[57] ABSTRACT

A turbomolecular pump coaxial with the drive shaft of a rotary anode in an X-ray tube is provided between the radial seal of the drive shaft and the high vacuum space surrounding the rotary anode. A pot-shaped shell mounted on the drive shaft where the latter passes through its bottom carries the rotor vanes, while the stator vanes are fixed on the tube casing. In order that the anode may be driven with the built-in electric motor located within the tube casing between the drive shaft bearings, at the high speed desirable for the turbomolecular pump, the rotary anode is cooled by water flowing through a set of closely adjacent helical ducts just inside of the working anode surface, running at a pitch of 10° to 15°, fed with cooling liquid from radial ducts and a ring duct along one end face of a rotary anode and drained by another ring duct and another set of radial ducts along the other face of the rotary anode.

6 Claims, 3 Drawing Figures

X-RAY TUBE WITH LIQUID-COOLED ROTARY ANODE

CROSS REFERENCE TO RELATED APPLICATION

Kussel; Haubold; Joswig and Klatt Ser. No. 886,391 filed Mar. 14, 1978.

This invention relates to an X-ray tube of the kind having a casing connected through an exhaust tube to a vacuum pump and containing a rotary anode in its high-vacuum enclosure that is cooled by a liquid, typically water, supplied and removed through co-axial ducts within the drive shaft of the rotary anode that is distributed to the cylindrical working member of the anode and gathered therefrom by radial ducts. In this type of straight tube, the drive shaft is typically mounted on two bearings and between the rotary anode and the nearer of these bearings a radial seal for the working vacuum is provided. An X-ray tube of the general type mentioned, was described in the Philips Technical Review, Vol 19, 1957/58, No. 11, pp. 362 to 365. In the tube there disclosed, the rotary anode, constituted as a hollow cylinder, has three radially running tubes through which the water would reach a cavity located along the inner surface of the peripheral wall or anode strip of the hollow body. In this device, the water flows back into the hollow drive shaft through three other tubes running radially in the rotary anode. There is a disadvantage in this known rotary anode, however, that only relatively low speeds of rotation can be obtained with it, because the peripheral wall provided as the anode target member, which cannot exceed a certain thickness on account of the cooling to be obtained, is not able to withstand pressures in the cooling medium that arise at higher speeds of revolution as the result of centrigual force. Only relatively small density of illumination (brightness) can be obtained with this known kind of X-ray tube, because the intensity of illumination and radiation per unit of surface depend upon the rate of revolution that can be used. There is a further disadvantage in the known X-ray tube, above mentioned, that hydrocarbons coming out of the radial seal provided between the rotary anode and the nearer of the drive shaft bearings proceed directly into the high-vacuum space. A relatively high spacing between anode and cathode must then be maintained in order to avoid damage to the tube from electrical breakdown resulting from the presence of these hydrocarbons.

It is, however, known from German Pat. No. 2,308,508, to provide a gap seal in such an X-ray tube between the radial seal and the high-vacuum space and to connect the intermediate space between the radial seal and the gap seal through a suction tube with a vacuum pump. In spite of these measures, however, even in this known modification of X-ray tube, the entry of hydrocarbon into the high-vacuum space is not completely prevented, and instead, the residual partial pressure for hydrocarbons in the high-vacuum space is reduced only to the region between $10^{-6}$ and $10^{-5}$ torr.

It is object of the present invention to provide a rotary anode that can be operated at speeds in the region between about 6000 and about 12,000 r.p.m. and also has an effective barrier for hydrocarbon gas coming out of the radial seal of the anode drive shaft facing the high-vacuum space.

SUMMARY OF THE INVENTION

Briefly, in an X-ray tube of the general type above described, the radial supply ducts for the cooling medium are connected together at their outer ends by a first set of cross ducts, and the radial discharge ducts for the cooling medium are likewise connected at their outer ends by a second set of cross ducts, while the cross ducts of the first set are connected to those of the second set by duct sections directly and firmly adjoining the portion of the rotary anode made of X-ray generating electron target material, immediately inward from said anode portion, and, in addition, a turbomolecular pump co-axial with the rotary anode drive shaft is interposed between the radial seal of the drive shaft and the high-vacuum space of the X-ray tube. The turbomolecular pump built into the X-ray tube has arrays of rotor and stator vanes alternatingly disposed in the axial direction, the former being part of a rotor driven in common with the drive shaft, and the stator vane arrays being mounted on the casing of the tube. The suction side of the built-in vacuum pump faces the high-vacuum space, while its discharge connection is provided through the usual suction tube connection to a gas-removal suction line that normally leads to a backup vacuum pump. By the construction of the anode cooling system in accordance with the invention it is possible to hold down to a small value the cross-sections of the individual cooling ducts, which as a practical matter should not exceed 0.5 $cm^2$ in the peripheral region of the rotary anode, and still to obtain a sufficient cooling of the portion of the rotary anode that functions as the electron target. As a result of the cooling duct cross-sections being small, the ducts can be so designed that they safely withstand the pressures in the cooling medium produced by centrifugal force. By the mechanical bonding of the anode target material with the high-strength material forming the duct structure, great mechanical strength is provided also for the anode that normally consists of copper or of a layer of molybdenum, silver or tungsten on copper, particularly because the duct structure provides many duct sections running parallel to each other for cooling of the anode.

By the building of a turbomolecular pump in accordance with the invention, between the high-vacuum space and the radial seal facing the rotary anode, a high vacuum practically free of hydrocarbons is obtained, because of means of a turbomolecular pump it is possible to obtain at the suction side of the pump a residual partial pressure for hydrocarbon that is too small to be measurable. Consequently, with an X-ray tube according to the invention, the anode and the cathode can be spaced relatively closely to each other because of the reduced risk of breakdown, which further favors the reduction of ion bombardment to a small value.

A further advantage of the X-ray tube according to the invention lies in the fact that with suitable design of the turbomolecular pump, there can be spared the expense of a supplementary pump installation for obtaining the high vacuum in the neighborhood of the anode that needs to amount to 1−7 to 10−5 torr at partial pressures of hydrocarbons of 10−10 torr, and the discharge side of the turbomolecular pump can go to a laboratory vacuum line or to a backup pump of much lower requirements. The X-ray tube according to the invention therefore has a compact form of construction that makes possible easy handling of the tube.

A particularly practical construction of an X-ray tube according to the invention is one in which the cross ducts at the outer ends of the cooling medium supply ducts and of the cooling medium discharge ducts respectively are in the form of ring ducts between which there run obliquely along the inner surface of the peripheral wall of the hollow anode a set of parallel cooling ducts, having a length not less than 150 nor more than 200 mm. In such a structure the radial supply ducts and their corresponding ring duct run along the inner surface of one end wall of the rotary anode and the radial discharge ducts and their corresponding ring duct run along the inner wall of the axially opposite end wall of the rotary anode. The obliquely running parallel duct sections connecting the two ring ducts are evenly distributed over the inner surface of the peripheral wall of the rotary anode that consists of a material for converting incident electron rays into emitted X-rays, and these ducts sections have their outer portions made of the peripheral wall material and their inner portions made of a material of high mechanical strength extending between the parallel duct sections and firmly bonded to the material of the outer peripheral wall, preferably by brazing or soldering.

Because the duct sections running parallel to each other along the inner surface of the outer peripheral wall of the rotary anode have a small duct cross-section and run at an angle of about 10° C. to 15° C. to the edge boundaries of the outer peripheral wall, and because of the fact that the strong material covering all but the outer portion of the ducts is firmly bonded to the outer peripheral wall of the anode, the outer peripheral wall of the anode itself has a high mechanical strength in the X-ray tube of the present invention. An X-ray tube with this type of construction of rotary anode can therefore be operated at speeds up to 12,000 revolutions per minute wihout any risk of overloading the anode material mechanically by the pressure of the cooling medium produced within the cooling duct sections, that can reach 90 bars in the case of a rotary anode with a diameter of 250 mm. The rotary speeds above referred to as suitable for anode operation are also adequate for the operation of the turbomolecular pump.

It is desirable in practice in the above-described design of X-ray tubes according to the invention, in the case of the hollow anode body having a diameter of 250 mm, that the cross-section of the cooling ducts in the peripheral region of the hollow body should not exceed the value of 0.5 $cm^2$. It is further appropriate that the portion of the cooling ducts consisting of the material of the outer peripheral wall of the anode should have a width that does not exceed 6 mm. A further practical feature of construction of an X-ray tube according to the invention consists in providing the rotor vanes of the turbomolecular pump on a pot-shaped shell co-axial with the drive shaft axis, so arranged that the drive shaft penetrates through the floor of the pot-shaped shell facing the rotary anode, and the lateral surfaces of the shell concentrically surround the radial seals, while the stator vanes are affixed to a part of the casing that laterally surrounds the pot-shaped rotor shell. Construction of X-ray tube that is particularly advantageous because of its compactness is provided if the drive for the drive shaft consists of an electric motor provided co-axially with the shaft between the two shaft bearings, with the rotor affixed to the drive shaft and the stator affixed to the facing of the tube. In this form of construction of X-ray tube according to the invention, all mechanical transmission members between motor and drive shaft are dispensed with. The drive is therefore easy to balance and is free of vibration.

The invention is further described by way of illustrative example with reference to the accompanying drawings in which.

Figure 1:
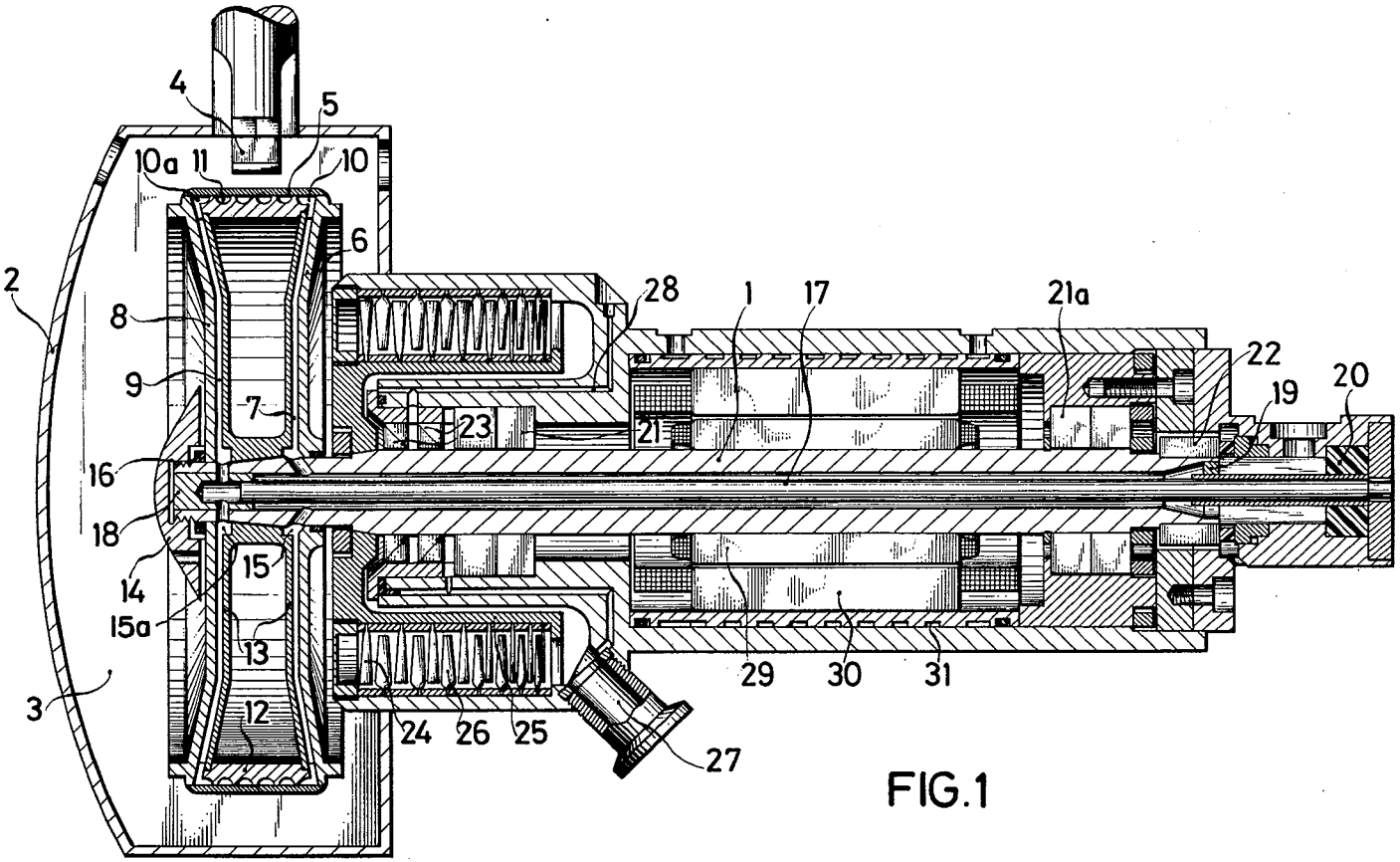
FIG. 1 is a longitudinal section through an X-ray tube of the invention passing through the tube axis.
Figure 2:
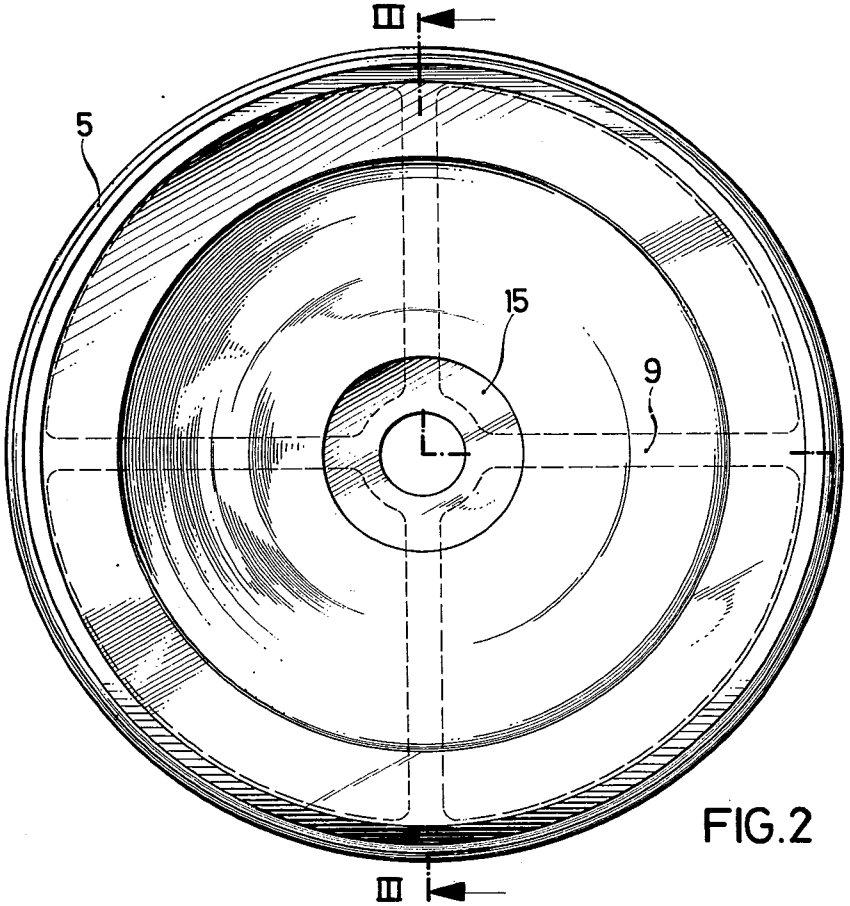
FIG. 2 is a cross-section through the rotary anode of the X-ray tube of FIG. 1, perpendicular to the tube axis, and FIG. 3 provides, to the left of the vertical axis, a radial cross-section of the rotary anode, and to the right of the axis, a side view with the peripheral anode strip wall stripped away.
Figure 3:
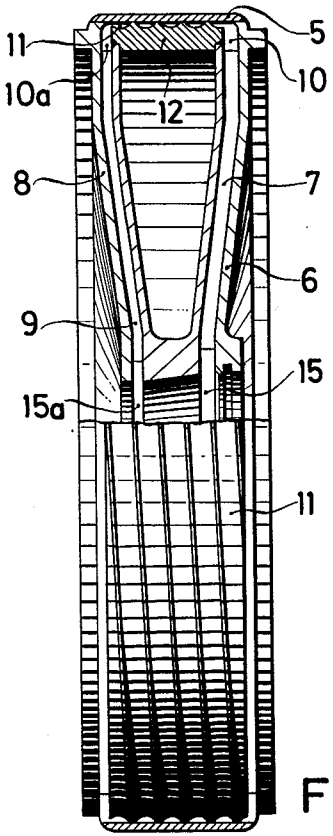

The X-ray tube shown in longitudinal section in FIG. 1 has a rotary anode symmetrical about its axis of revolution that is mounted on a hollow drive shaft 1 located in a high-vacuum chamber 3 enclosed by the casing 2 into which the cathode 4 projects to a position opposite the rotating cylindrical periphery 5 of the anode. As can be seen in this figure and also in the left-hand portion of FIG. 3, the anode is constituted as a hollow body with a working anode strip of copper constituting the peripheral wall 5 of the hollow body. Just inside the end face 6 of the hollow body are a number of cooling liquid ducts 7 running radially on the inside of the end face or cover, and likewise there are discharge ducts 9 for the cooling medium running radially along the inside of the other end face 8. Ring duct 10 connects the supply duct 7 together at their outer ends and a ring duct **10*a* similarly connects together the outer end of the discharge ducts 9. The two ring ducts 10 and 10*a* are connected together by cooling duct sections 11. The material of the peripheral wall 5 forms the outer boundary of the cooling ducts 11 and a part 12 made of stainless steel, having the shape of a ridged tire or hoop, forms the inner boundaries of the cooling ducts. As can be seen from the right-hand portion of FIG. 3, a side view of a portion of the rotary anode where the copper peripheral wall has been stripped away, the duct sections 11 each connecting the input and output ring ducts run obliquely at an angle of 15° C. to the edge boundaries of the peripheral wall 5**. The drawing does not show the curvature of the peripheral wall, which is understood to be present. Since these cooling ducts run along the curved surface of the peripheral wall, their course may generally be described as helical and in the particular embodiment illustrated their length is somewhat longer than one turn and less than one and one-half turns around the inside of the peripheral wall. These duct sections run at a constant axial spacing to each other, which may be described as a parallel arrangement, and they are of course distributed equally over the peripheral wall inner surface.

The part 12 extends into the space between ducts 11 and is soldered to the peripheral wall 5, as well as to the inner part 13 forming the radial ducts 7 and 9, as well as at least part of the related ring ducts 10 and **10*a*. Finally, the peripheral wall 5 is soldered to the end walls 6 and 8** so as to complete the anode body. These parts are all soldered together at high temperature, about 1000° C., which is to say that the bonding may be referred to as hard soldering or brazing, according to the particular solder or brazing compound used. This operation is carried out at high vacuum so that the rotary anode will be degassed and will be unable to set free any more gas after it has been completed, and put into operation under electron bombardment of the peripheral wall.

As can further be seen from FIG. 1, the rotary anode body is demountably fastened to the drive shaft 1. For its attachment to the shaft, the rotary anode body is placed or pushed onto the conical end portion of the drive shaft 1 and screwed down tight by means of the nut 14. Openings are provided in the conical portion of the drive shaft for supply and discharge of the cooling medium, normally water. These openings lead into central ring ducts 15 and 15*a*, which are connected with the inner ends of the radially running ducts 7 and 9 respectively. The inner tube 17 provided co-axially in the drive shaft 1 is firmly affixed within the drive shaft 1 by the end piece 18 and by the holding assembly 19 consisting of ring segments, and the tube 17 is further seated in a graphite slip bearing 20.

The drive shaft 1 is itself mounted in two bearings 21 and 21*a*, as also appears in FIG. 1. A slip ring seal 22 is provided between the drive shaft and the casing. Between the radial seal 23 and the high vacuum space 3 is located a turbomolecular pump having alternating arrays of rotor vanes and stator vanes disposed in the axial direction of the turbine rotor. The rotor vanes 24 are affixed to a pot-shaped shell 25 that has its axis of revolution coinciding with that of the drive shaft 1. The drive shaft 1 penetrates through the bottom of the shell 25 and is firmly affixed to the latter at that place. The stator vanes 26 are affixed to a portion of the X-ray tube casing, which laterally surrounds the shell 25 and its rotor vanes. The suction side of the turbomolecular pump faces the high vacuum space surrounding the rotary anode, while at the discharge side of the turbomolecular pump, a tubular fitting 27 is provided passing through the tube casing for connection to a suction line. The tubular connection 27 is thereby connected to a pumping installation not shown in the drawing. Finally, another suction connection 28 is provided for the space between the elements of the radial seal 27.

The drive of the rotary anode, as shown in FIG. 1, is provided by an electric motor interposed between the two shaft bearings 21 and 21*a*, the rotor 27 being arranged to rotate co-axially with the shaft 1 on which it is mounted preferably affixed thereto by being shrunk onto the shaft. The stator 28 of the electric motor is affixed to the casing of the X-ray tube. Ducts 29 for a cooling medium are provided for cooling the motor.

The electric motor is preferably a water-cooled built-in asynchronous (induction) motor with a static frequency converter. After starting up with a frequency change from 30 to 200 Hz, this motor reaches a speed of 12,000 r.p.m. at a power consumption of 3.5 kVA. As mentioned before, this speed is also appropriate for operating the turbomolecular pump. Continuous operation of the X-ray tube shown in the drawing can be maintained at a power level of 100 kW.

Although the invention has been described with reference to a specific illustrative embodiment, it will be evident that variations are possible within the inventive concept.

I claim:

1. An X-ray tube having a rotary liquid-cooled anode mounted on a hollow drive shaft and served with cooling medium through radial supply and discharge ducts in the anode and coaxial supply and discharge ducts in said shaft, said shaft being mounted on two bearings and being provided with a radially disposed vacuum seal between the anode and the one of the shaft bearings that is nearer to the anode, the tube further comprising the improvement that consists in that:

the radial cooling medium supply ducts (7) are connected together by a first set of cross ducts (10), the radial cooling medium discharge ducts (9) are connected together by a second set of cross ducts (10*a*), and the cross ducts of the first set are connected to those of the second set by duct sections (11) directly and firmly adjoining the portion (5) of the rotary anode made of X-ray generating electron-target material, immediately inward of said anode portion, and between said vacuum seal (22) and the high vacuum space of the X-ray tube a turbomolecular pump coaxial with said drive shaft is interposed having rotor (24) and stator (26) vane arrays, alternatingly disposed in the axial direction, the rotor vane arrays being part of a rotor driven in common with said drive shaft, the stator vane arrays being fixed on the tube casing, the suction side of said pump facing said high vacuum space (3), and a discharge connection (27) being provided for said pump through the tube envelope for the discharge side of the pump for connection to a gas removal suction line.

2. An X-ray tube as defined in claim 1 in which each of said sets of cross ducts (10,10*a*) forms a ring duct, and in which, further, said rotary anode is in the form of a hollow body having a peripheral wall (5) constituting that portion of said anode made of X-ray generating electron target material, and in which, further, said duct sections (11) run obliquely along the inner surface of said peripheral wall and have a length not less than 150 nor more than 200 mm, and in which, further, said radial cooling medium supply ducts and the ring duct cross connecting them are located on the inside of one end face wall (6) of said hollow body and the radial cooling medium discharge ducts (9) and the ring duct cross connecting them run on the inside of the opposite end face (8) of the hollow body and in which further, the duct sections (11) run parallel to each other and are evenly distributed over the peripheral wall (5), and are formed on the outside by the material of said peripheral wall (5) and on the inside by a mechanically strong material extending between the said duct sections (11) and firmly bonded to the material of said peripheral wall (5).

3. An X-ray tube as defined in claim 2 in which said hollow body of said anode has a diameter not greater than 250 mm and in which the cross-section of each said ducts and duct sections in the neighborhood of the periphery of said hollow body has an area not exceeding 0.5 $cm^2$.

4. An X-ray tube as defined in claim 3 in which the portion of said duct sections (11) connecting said ring ducts which is made of the material of said peripheral wall (5) has a width not exceeding 6mm.

5. An X-ray tube as defined in claim 1 in which the vanes of said rotor vane arrays (24) are mounted on a cup-shaped shell (25) having the same axis of rotation as said drive shaft (1) and so disposed with respect to said drive shaft that said drive shaft penetrates through the floor of said shell and the outer surface of the floor of said shell (25) faces the rotary anode while the lateral surfaces of said shell concentrically enclose said radial seal (22) and, further, the vanes of said stator vane arrays (26) are mounted on a portion of the casing of said tube that concentrically surrounds said shell laterally.

6. An X-ray tube as defined in claim 1 in which an electric motor is provided for driving said drive shaft (1), said motor being provided between said tube bearings of said drive shaft in such a way that the axes of rotation of said drive shaft and of the rotor (29) of said electric motor coincide and said rotor is affixed to said drive shaft, while the stator (30) of said electric motor is affixed to the casing of the X-ray tube.

* * * * *